US009035837B2

(12) United States Patent
Kwak et al.

(10) Patent No.: US 9,035,837 B2
(45) Date of Patent: May 19, 2015

(54) BUILT-IN ANTENNA FOR ELECTRONIC DEVICE

(71) Applicant: Samsung Electronics Co., Ltd., Gyeonggi-do (KR)

(72) Inventors: Yong-Soo Kwak, Gyeonggi-do (KR); A-Hyun Sin, Gyeonggi-do (KR); Dong-Hyun Lee, Ulsan (KR); Seong-Tae Jeong, Gyeonggi-do (KR); Joon-Ho Byun, Gyeonggi-do (KR)

(73) Assignee: Samsung Electrics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 180 days.

(21) Appl. No.: 13/747,829

(22) Filed: Jan. 23, 2013

(65) Prior Publication Data

US 2013/0234903 A1 Sep. 12, 2013

(30) Foreign Application Priority Data

Mar. 9, 2012 (KR) ..... 10-2012-0024590

(51) Int. Cl.

| | |
|---|---|
| ***H01Q 9/00*** | (2006.01) |
| ***H01Q 5/00*** | (2006.01) |
| ***H01Q 1/24*** | (2006.01) |
| ***H01Q 9/42*** | (2006.01) |

(52) U.S. Cl.

CPC ..... *H01Q 5/0034* (2013.01); *H01Q 1/243* (2013.01); *H01Q 5/0058* (2013.01); *H01Q 9/42* (2013.01)

(58) Field of Classification Search

USPC ..... 343/700 MS, 702, 745, 749

See application file for complete search history.

(56) References Cited

U.S. PATENT DOCUMENTS

| | | | | |
|---|---|---|---|---|
| 7,012,570 | B2 * | 3/2006 | Chen et al. | 343/700 MS |
| 8,279,121 | B2 * | 10/2012 | Ishizuka et al. | 343/700 MS |
| 8,643,558 | B2 * | 2/2014 | Tseng et al. | 343/750 |
| 2005/0168384 | A1 | 8/2005 | Wang et al. | |
| 2010/0053007 | A1 * | 3/2010 | Ni et al. | 343/745 |
| 2011/0199272 | A1 * | 8/2011 | He et al. | 343/741 |
| 2012/0105292 | A1 * | 5/2012 | Wong et al. | 343/749 |
| 2012/0146865 | A1 | 6/2012 | Hayashi et al. | |

FOREIGN PATENT DOCUMENTS

KR 10-2009-0049513 A 5/2009

* cited by examiner

*Primary Examiner* — Tan Ho

(74) *Attorney, Agent, or Firm* — Cha & Reiter, LLC

(57) ABSTRACT

A built-in antenna apparatus for a electronic device is provided. The antenna apparatus comprises a PCB with conductive and non-conductive areas. An antenna radiator is disposed at the non-conductive area of the PCB; the antenna radiator has a feeding portion and at least a first radiating portion configured in a first pattern branched from the feeding portion and has an end portion electrically connected to the conductive area. At least one capacitor is electrically connected in series within the first radiating portion. A resonant frequency of the first radiating portion is a function of a capacitance value of the at least one capacitor. The antenna can be provided in a smaller size for a given frequency band due to the capacitance. A second antenna radiator branched from the feeding portion can also be provided for operation at a different frequency band.

20 Claims, 9 Drawing Sheets

BUILT-IN ANTENNA FOR ELECTRONIC DEVICE

CLAIM OF PRIORITY

This application claims the benefit under 35 U.S.C. §119 (a) of a Korean patent application filed in the Korean Intellectual Property Office on Mar. 9, 2012 and assigned Serial No. 10-2012-0024590, the entire disclosure of which is hereby incorporated by reference.

BACKGROUND

1. Technical Field

The present disclosure relates to a built-in antenna within an electronic device.

2. Description of the Related Art

As a type of electronic device, portable terminals have recently been recognized as one of the necessities of everyday modern life. A portable terminal is generally any hand held electronic device capable of receiving a radio frequency (RF) signal. A portable terminal can be a cell phone, a smart phone, an e-book, a camera, a personal digital assistant (PDA), a tablet PC, and the like.

Portable terminal performance has continued to improve in terms of functionality, processing speed, memory, battery life, and footprint (reductions in size, weight and thickness). To satisfy customers, it is desirable to provide thin, lightweight and small devices (with the exception of display size which has recently trending higher) with as many functions as possible. Portable terminal vendors are competing to implement smaller and slimmer terminals while providing equivalent or more advanced performance.

Early stage portable terminals used external antennas (e.g., a rod antenna or a helical antenna), which are vulnerable to damage when the terminal is dropped, thereby deteriorating portability. Recent designs have used one or more built-in antennas to eliminate this problem. The built-in antenna within the portable terminal is designed with an antenna radiator of a specific length to achieve a target antenna performance at requisite frequencies, such as radiation pattern, efficiency and S parameter metrics. The antenna thus operates in proportion to a physical property and size of the antenna radiator. For a given operating frequency band(s), if the antenna radiator length is shortened within the terminal in accordance with the trend of making the terminal small and thin, antenna performance can suffer.

In particular, as one antenna radiator, a recently launched portable terminal uses a multi-band antenna radiator which operates at two bands (dual-band design) or more. When applying the multi-band antenna, a physical length of the antenna radiator is increased by a specific length (typically $\lambda/2$ or $\lambda/4$), which has a limitation. Further, an installation process is complex due to an additional component such as a carrier, and manufacturing cost is increased.

For example, when using a dual-band antenna designed for 2.4/5 GHz, in the case of an Inverted F Antenna (IFA) type, an electrical length of an antenna radiator is about 25~30 mm (i.e., $\lambda/4$ at the 2.4 GHz band). A non-conductive area on a Printed Circuit Board (PCB) having the antenna radiator installed or formed thereon must be larger in size than this electrical length. As a result, the space allotted to the antenna within portable terminal is larger, undesirably increasing the size of the portable terminal.

SUMMARY

An aspect of the present invention is to solve at least the above-mentioned problems and/or disadvantages and to provide at least the advantages described below. Accordingly, an aspect of the present invention is to provide a built-in antenna for an electronic device implemented to provide a slim electronic device.

Another aspect of the present invention is provide a built-in antenna for an electronic device implemented to save manufacturing cost by enabling a direct implementation on a Printed Circuit Board (PCB) and to improve productivity by reducing the number of assembly processes.

In accordance with an aspect of the present invention, a built-in antenna for an electronic device is provided. The antenna apparatus comprises a PCB with conductive and non-conductive areas. An antenna radiator is disposed at the non-conductive area of the PCB. The antenna radiator has a feeding portion and at least a first radiating portion configured in a first pattern branched from the feeding portion, and has an end portion electrically connected to the conductive area. At least one capacitor is electrically connected in series within the first radiating portion. A resonant frequency of the first radiating portion is a function of a capacitance value of the at least one capacitor.

Advantageously, by employing the capacitor in conjunction with the electrical connection of the end portion of the first radiator to the conductive area, enables the first radiator to be made smaller while achieving resonance at a desired frequency. A second antenna radiator branched from the feeding portion can also be provided for operation at a different frequency band.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION OF EXEMPLARY EMBODIMENTS

Exemplary embodiments of the present invention will be described herein below with reference to the accompanying drawings. In the following description, well-known functions or constructions are not described in detail to avoid obscuring the invention in unnecessary detail.

Although a bar-type smart phone having a touch screen in a front surface thereof is illustrated and described as an electronic device to exemplify the present invention, the present invention is not limited thereto. Various other electronic devices having a built-in antenna for wireless transmission and reception are within the scope of the invention. In addition, a dual-band built-in antenna is described in the examples hereafter with radiation patterns respectively operating two frequency bands (2.4 GHz and 5 GHz) implemented in one antenna radiator. However, the present invention is also applicable to a multi-band built-in antenna operating at three or more bands. Further, principles of the invention can be applied to a single band operation, in which antenna size reduction is achieved for use as a single band antenna.

Figure 1:
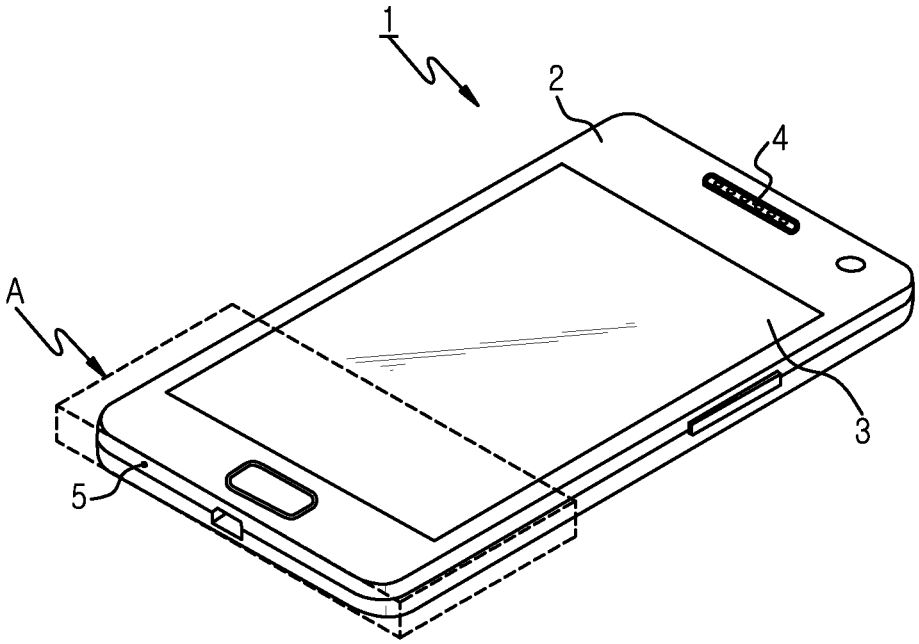
FIG. 1 is a perspective view of an electronic device employing a built-in antenna according to an exemplary embodiment of the present invention.

FIG. 1 is a perspective view of an electronic device 1 employing a built-in antenna according to an exemplary embodiment of the present invention. Electronic device 1 has a touch screen 3 on a front surface 2 to perform a data input/output function. A speaker 4 is located in an upper portion of the terminal to output sound of a peer user or an audio player. A microphone 5 is installed in a lower portion to deliver a voice input to the peer user. Although not shown, a digital camera can be installed in a rear surface of the electronic device 1.

A Printed Circuit Board (PCB) (see 12 of FIG. 2) used as a main board is installed in the electronic device. An antenna radiator (see 11 of FIG. 2) of the present invention is installed or formed at the PCB (see 11 of FIG. 2) in a form of a conductor pattern. In other embodiments, the antenna radiator can be embodied as a metal plate having a specific pattern on a constituent part (e.g., a housing) of the terminal, or affixed to the PCB or constituent part, or as a Flexible Printed Circuit (FPC) having a specific pattern attached or installed in the PCB 12.

As illustrated in FIG. 1, a built-in antenna (see 10 of FIG. 2) of the present invention is preferably located at a lower portion (i.e., a position A of FIG. 1) of the electronic device 1. An advantage of the lower portion location is that human interference has the least effect in a state where the electronic device 1 is in a hand-held state, and the built-in antenna is separated from the user's head during a call state by the greatest distance. However, the present invention is not limited thereto, and thus the antenna can be alternatively placed at an upper or center portion of the electronic device as long as the chosen configuration provides effective shielding of the antenna and prevents radiation performance deterioration.

Figure 2:
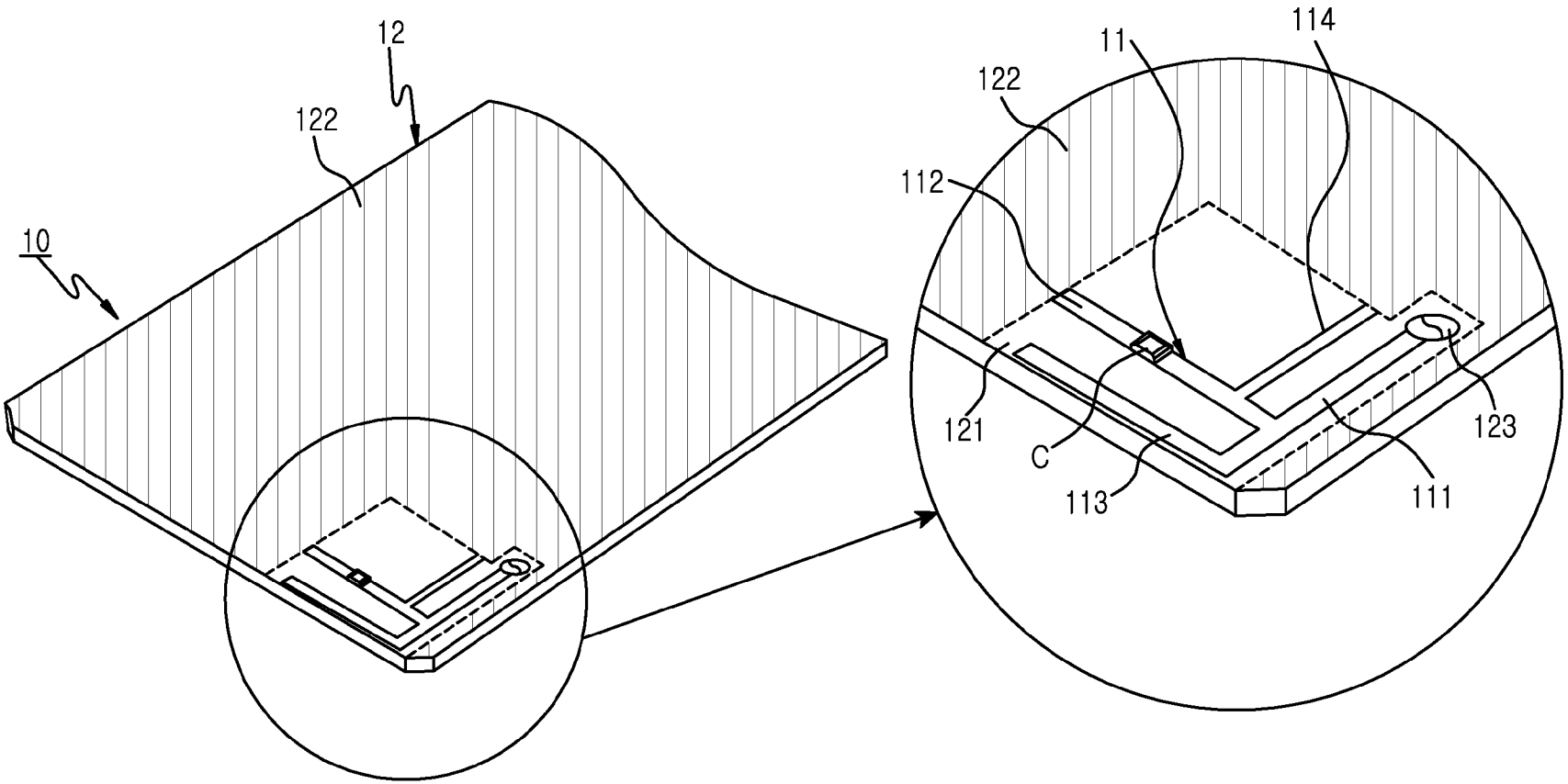
FIG. 2 is a perspective view of a built-in antenna that may be used in the electronic device of FIG. 1 according to an exemplary embodiment of the present invention.
Figure 3:
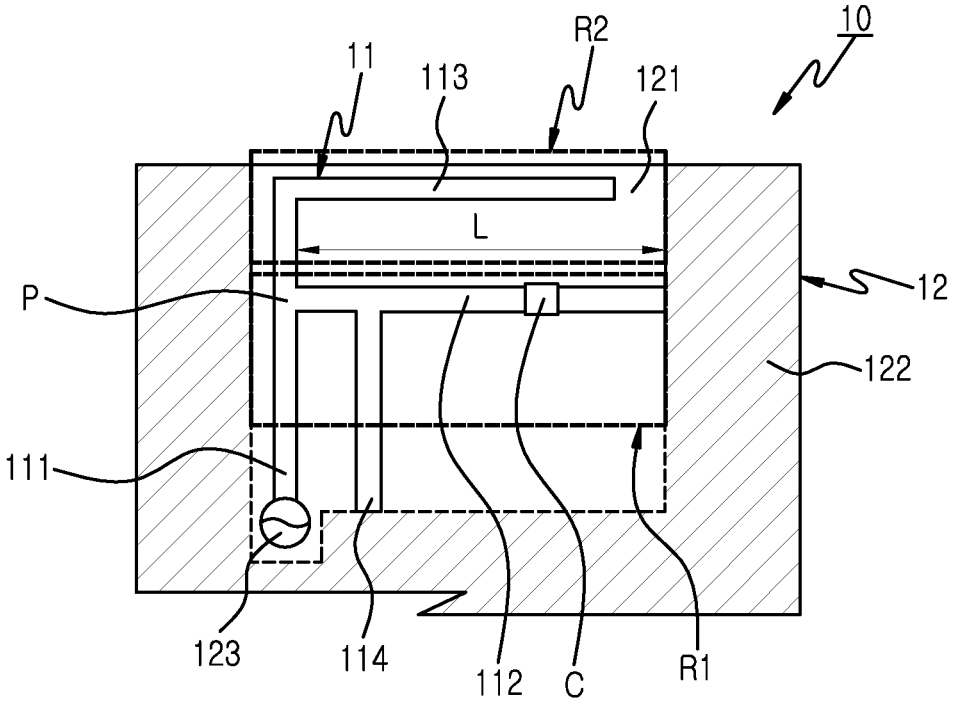
FIG. 3 is a plan view of the built-in antenna of FIG. 2 according to an exemplary embodiment of the present invention.

FIG. 2 is a perspective view of the built-in antenna within the electronic device of FIG. 1 according to an exemplary embodiment of the present invention. FIG. 3 is a plan view of the built-in antenna of FIG. 2 according to an exemplary embodiment of the present invention.

Referring to FIGS. 2 and 3, a built-in antenna 10 (interchangeably, "antenna apparatus") of the present invention includes a PCB 12 installed inside the electronic device 1. The PCB 12 includes a non-conductive area 121 and a conductive area 122, where the conductive area is preferably part of a reference ground for electronic device 1. The antenna 10 includes an antenna radiator 11 disposed at the non-conductive area 121, e.g., formed on the PCB 12 surface or otherwise mounted or formed at that location. PCB 12 also has various integrated circuit components mounted thereon (not shown). Preferably, the antenna radiator 11 is formed on the PCB 12 in a conductor pattern. However, the present invention is not limited thereto. As described above, the antenna radiator may be formed by attaching a metal plate having a specific pattern formed thereon, or as an FPC including a specific metal pattern. (Note that when the built-in antenna 10 is said to "include the PCB 12," this generally refers to the portion of the PCB 12 that acts as a part of the antenna 10, and not to other areas of the PCB 12 upon which other circuit components are mounted. The PCB portion acting as part of the antenna 10 in FIG. 3 is essentially the shown conductive and non-conductive areas 122, 121.)

The antenna radiator 11 includes an RF feeding portion 111, a first radiating portion 112 and a second radiating portion 113. The feeding portion 111 (also commonly called a feed line) is preferably in the form of a conductive strip pattern with a specific length and is electrically connected to a Radio Frequency (RF) node 123 in the non-conductive area 121 of the PCB 12. Feeding portion 111 feeds RF signal power between the RF node 123 and the first and second radiating portions 112, 113. The first and second radiating portions 112, 113 are each branched from the power feeding pattern 111 at the point P and formed in an extended manner. As will be explained further below, RF signals of at least two different frequency bands, such as the 2.4 GHz and 5 GHz bands, are preferably transferred by the common feeding portion 111, with the signals of one band being radiated by radiating portion 112 and the those of the other band by radiating portion 113. In the embodiment of FIG. 3, the first radiating portion 112 includes a conductive pattern 114 branching out in the form of a right angle stub, electrically connected to the conductive area 122 of the PCB 12. The stub 114 serves to impedance match the first radiating portion 112. In other embodiments such as those illustrated below, a stub connection is instead made from the feeding portion 111, or a stub originates from the second radiating portion 113.

The first radiating portion 112 is branched at the point P from the power feeding pattern 111 at one end thereof ("near end") and electrically connected to the conductive area 122 of the PCB 12 at the opposite end ("far end"). Therefore, the first radiating portion 112 is implemented with a specific loop type configuration in conjunction with the feeding portion 111. Further, at least one capacitor C such as a chip capacitor is electrically connected in series within the first radiating portion 112. That is, the first radiating portion 112 is separated in the region below the capacitor C to provide separated sections (not shown) and the capacitor C is connected across the two sections. By inserting the capacitor C, a resonant frequency can be regulated according to a capacitance value of the capacitor. The capacitor C results in a lengthening of the effective electrical length of the first radiating portion 112. For example, assume the first radiating portion 112 is designed with a specific electrical length to radiate and receive signals at a frequency f1. Without the capacitor C, the physical length L of the radiating portion 112 would need to be longer than that shown in FIG. 3, such that the non-conductive area 121 would need to be wider. The insertion of the capacitor allows for a smaller physical length L to achieve resonance at the same frequency f1.

The second radiating portion 113 is bent by a specific angle from an end portion of the power feeding pattern 111. An end portion of radiating portion 113 has an open form and thus is not electrically connected to the conductive area 122 of the PCB 12, i.e., it is isolated from the conductive area 122. Therefore, together with the power feeding pattern 111, the second radiating portion 113 can be a structure of monopole, Inverted-L Antenna (ILA), Inverted-F Antenna (IFA), etc. In the embodiment of FIG. 3, radiating portion 113 is in the form of an ILA antenna.

As shown in FIG. 3, the antenna 10 of the present invention is described by taking an example of the antenna radiator 11 in which a first antenna radiator R1 and a second antenna radiator R2 are formed in an integral fashion. The first antenna radiator R1 includes the feeding portion 111 and the first radiating portion 112 and operates at a low frequency band. The second antenna radiator R2 includes the power feeding pattern 111 and the second radiating portion 113 and operates at a relatively high frequency band.

In this case, the first antenna radiator R1 may operate at a relatively low frequency band, e.g., a 2.4 GHz band, and the second antenna radiator R2 may operate at a relatively high frequency band, e.g., a 5 GHz band. Logically, an electrical length of the first radiating portion 112 is longer than, more specifically, about two times longer than an electrical length of the second radiating portion 113 for a similar type antenna design.

The electrical length of the first radiating portion 112 having an IFA structure is $\lambda/4$ in general. The length of the second radiating portion 113 in the form of an ILA is allowed to be shorter than $\lambda/4$, and, since designated for the higher band, is shorter than the radiating portion 112. A length of a radiator is in inverse proportion to a frequency band in use. Accordingly, a width of the non-conductive area 121 of the PCB 12 (in the orientation shown where the radiators extend in left to right in the width direction) must conventionally be greater than at least $\lambda/4$, i.e., the electrical length of the first radiating portion 112. Thus, since a size of the PCB 12 cannot be decreased, it is difficult to make the terminal slim (in this case, it is difficult to reduce the size of the terminal in a widthwise direction).

However, according to the present invention, the resonant frequency can be designed on the basis of a capacitance value in use by connecting the capacitor C having a specific value in series in the first radiating portion 112, and thus it is also possible to decrease a physical length L of the first radiating portion 112. That is, the use of the capacitor C lengthens the effective electrical length of the first radiator R1.

As illustrated in the embodiment of FIGS. 2-3, the feeding portion 111 can be in the form of a conductive strip on the same surface as the first and second radiating portions 112, 113. The first radiating portion 112 and a majority portion of the second radiating portion 113 are oriented substantially parallel to each other and each are substantially perpendicular to the feeding portion 111. The first and second radiating portions 112, 113 are oriented from near to far sides, with the feeding portion 111 disposed at the near side. The conductor area 122 is disposed at least at a far side of the non-conductive area 121, and the end portion of the first radiating portion 112 is connected to the conductive area 122 at the far side. The conductor area 122 further extends to a central region beneath the non-conductive area 121, and the first radiating portion 12 has a stub 114 in the vicinity of the near side, which connects to the central region of the conductive area. However, it is understood that other configurations are possible. For instance, in some applications, only the first antenna radiator R1 is used, and the second antenna radiator R2 is omitted.

In the various illustrated embodiments herein, the RF feeding portion 111 is shown extending in a substantial relative length from the RF node 123 to the radiating portions 112, 113. However, in alternative embodiments, RF power can be fed directly (from another level beneath or above the top PCB surface) to the point P at the intersection between the first and second radiating portions 112, 113.

The RF feed node 123, shown schematically, is a node of a two conductor transmission line (e.g., coaxial, microstrip or stripline configuration) in which a first conductor (e.g. inner conductor of a coaxial line) is connected to the feeding portion conductor 111 and the second conductor (e.g. outer conductor) is electrically connected to the conductive area 122.

Figure 4:
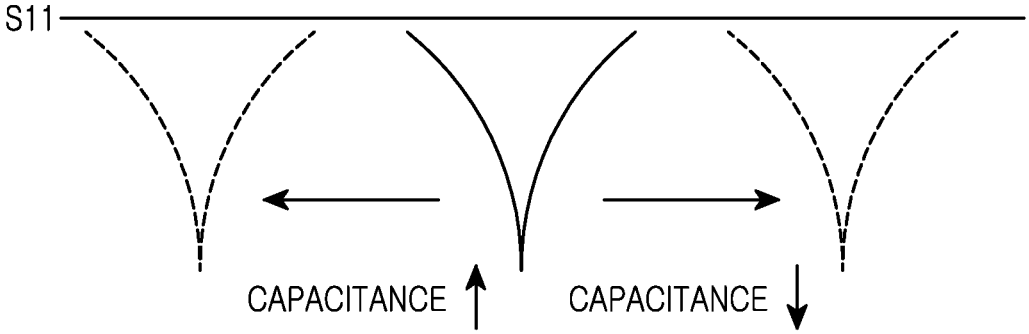
FIG. 4 is a schematic view illustrating a change in a resonance frequency depending on a capacitor value used in the built-in antenna of FIG. 1 according to an exemplary embodiment of the present invention.

FIG. 4 is a schematic view illustrating a change in a resonance frequency depending on a capacitor value used in the built-in antenna of FIG. 1 according to an exemplary embodiment of the present invention. The resonant frequency generally refers to a frequency at which the antenna is optimally tuned, i.e., the frequency at which the antenna has nearly ideal characteristics.

Referring to FIG. 4, when a capacitor C is applied in the first radiating portion 112, if a value of the capacitor C is great, the pattern operates at a resonant frequency of a low frequency band, and if the value of the capacitor C is low, the pattern operates at a resonant frequency of a high frequency band.

Therefore, the first radiating portion 112 of FIG. 3 can be decreased by a length of the second radiating portion 113, and the capacitor C having a corresponding capacitance value is connected in series in the first radiating portion 112, so that the first radiating portion 112 operates at a desired resonant frequency band.

Therefore, the width of the non-conductive area 121 of the PCB 12 can be decreased by the decreased electrical length of the first radiating portion 112, which can facilitate making the terminal slim.

Figure 5:
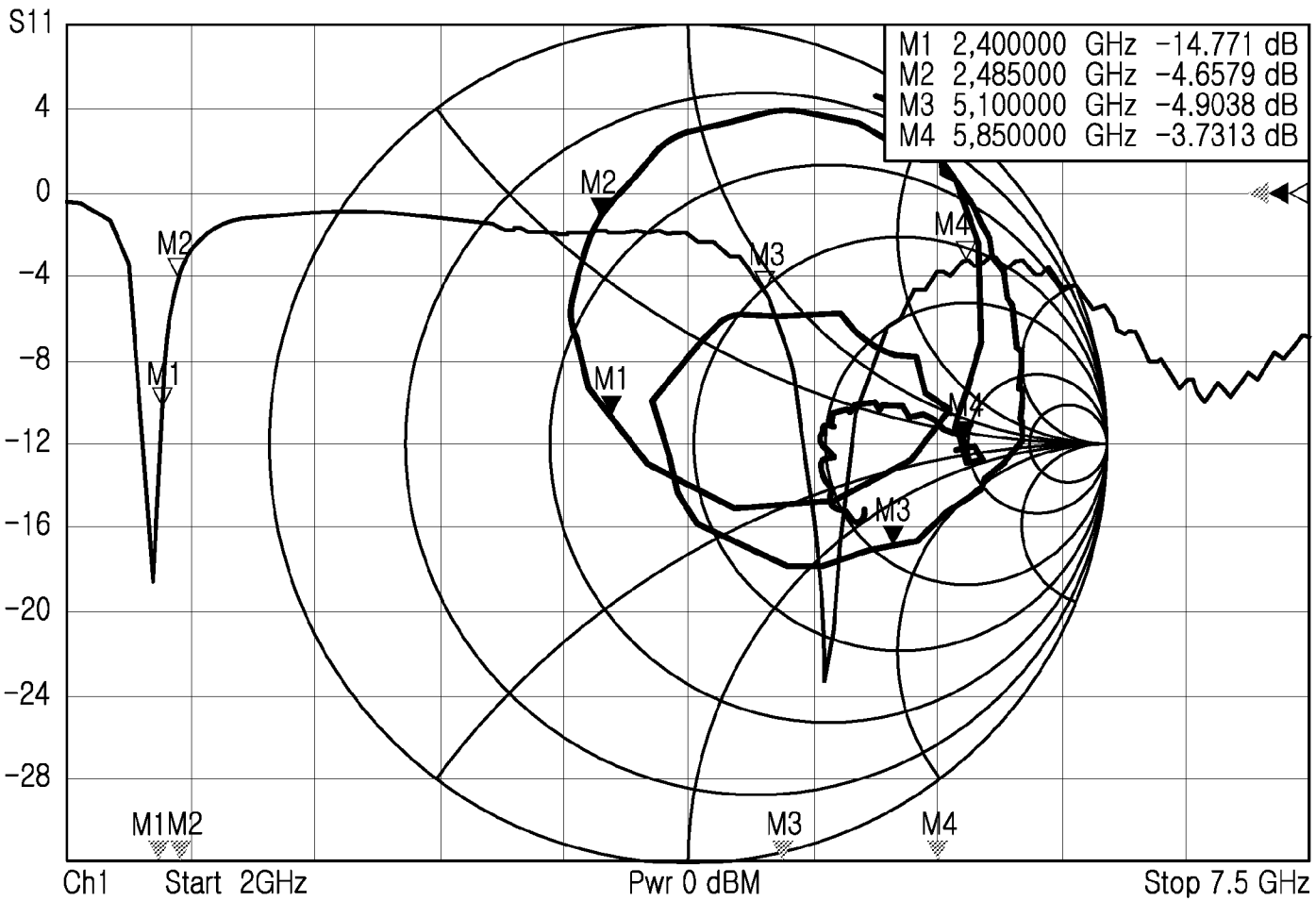
FIG. 5 is a graph illustrating a Voltage Standing Wave Ratio (VSWR) and a Smith chart when applying the built-in antenna of FIGS. 2-3 according to an exemplary embodiment of the present invention.

FIG. 5 is a graph illustrating a Voltage Standing Wave Ratio (VSWR) and a Smith chart when applying the built-in antenna of FIGS. 2 and 3 according to an exemplary embodiment of the present invention.

Conventionally, when the first radiating portion 112 is used at a frequency band of 2.4 GHz, a length of the conventional IFA-type antenna radiator must be formed with a length of $\lambda/4$ at ~2.4 GHz, i.e., 25~30 mm. However, embodiments of the present invention can implement the first antenna radiator R1 having a length of ~9 mm in the non-conductive area 121 of the PCB 12 by applying a capacitor to the first radiating portion 112.

Therefore, for the example as illustrated in FIG. 5, efficiency of 68.6% (−1.64 dB) can be attained with respect to an input at the frequency band of 2.4 GHz. Efficiency of 53.1% (−2.75 dB) can be attained with respect to the input at a frequency band of 5 GHz. As a result, the antenna 10 of the present invention has the same or superior property in comparison with the typical antenna which exhibits efficiency of 30~60% with respect to the input (in general, performance is considered excellent if the efficiency is greater than or equal to 50%).

Figure 6:
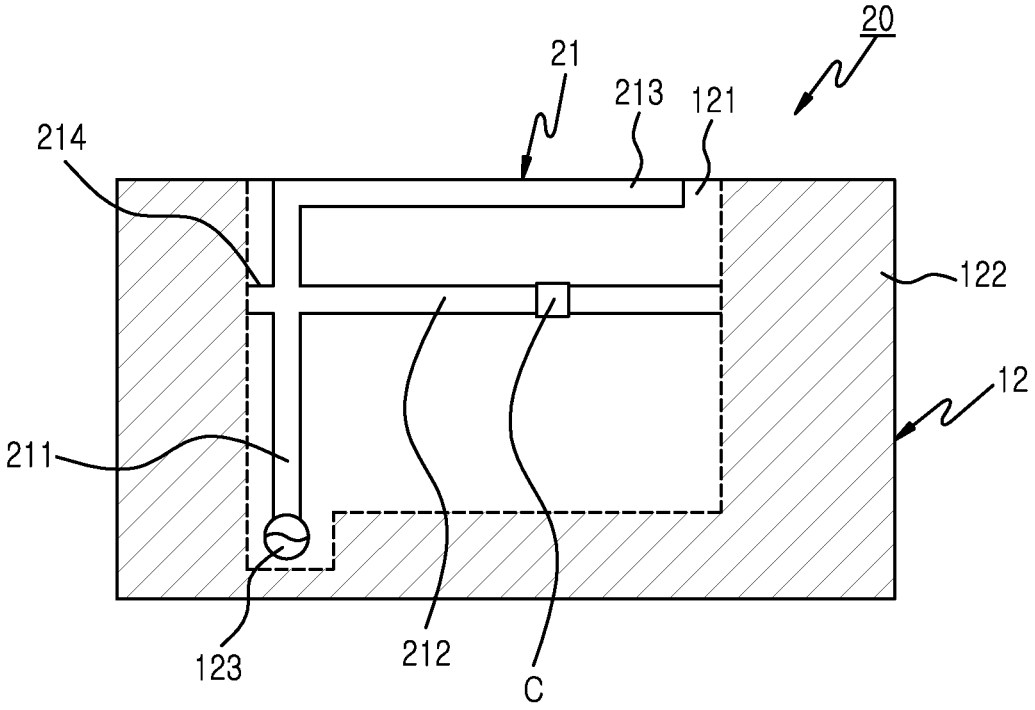
FIG. 6 is a plan view of a built-in antenna according to a second exemplary embodiment of the present invention.

FIG. 6 is a plan view of a built-in antenna 20 according to a second exemplary embodiment of the present invention. The antenna 20 has the same configuration as the antenna 10 of FIGS. 2-3, except that the short-circuited stub 114 extending from the first radiator is replaced with a short circuited stub 214 extending from an RF feeding portion.

An antenna radiator 21 is disposed at a non-conductive area 121 of a PCB 12. The antenna radiator 21 includes a feeding portion 211 having a specific length and electrically connected to an RF node 123, a first radiating portion 212 branched from the feeding portion 211 and placed to be connected with a capacitor C in series, and a second radiating portion 213 extended in a direction in which the first radiating portion 212 is branched from an end portion of the feeding portion 211. In this case, an end portion of the first radiating portion 212 is electrically connected to a conductive area 122 of the PCB 12, and an end portion of the second radiating portion 213 is open and thus is not connected to the conductive area 122 of the PCB 12. Unlike FIG. 2, a conductive pattern 214 is branched in an opposite direction of the first radiating portion 212 in the feeding portion 211 and is electrically connected to the conductive area 122 of the PCB 12.

Figure 7:
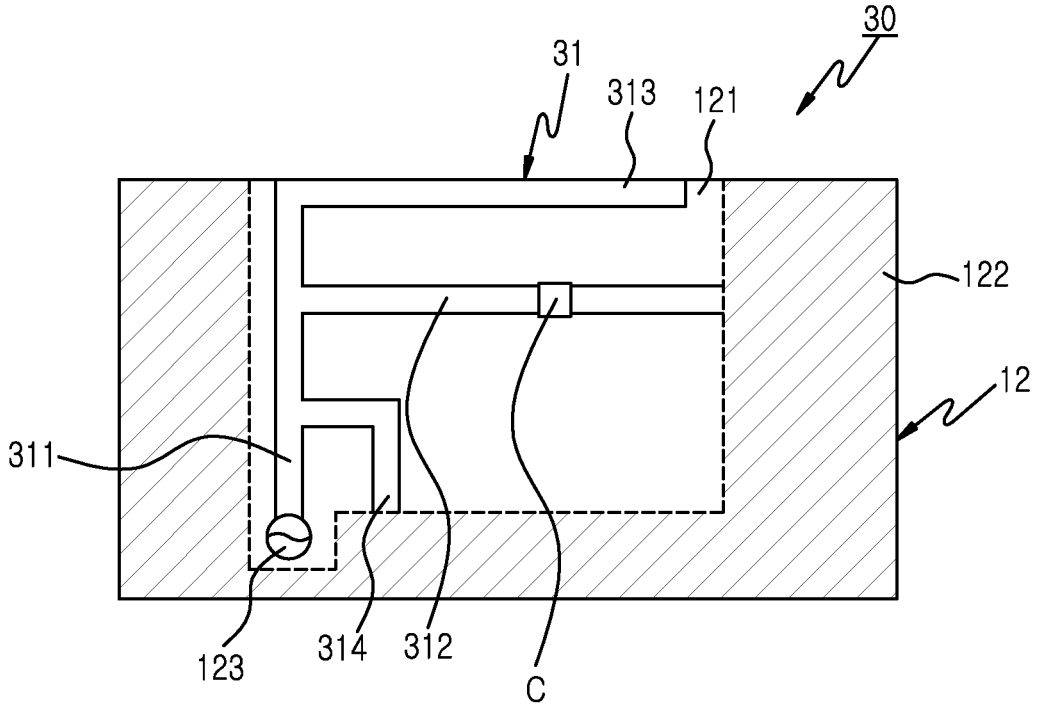
FIG. 7 is a plan view of a built-in antenna according to a third exemplary embodiment of the present invention.

FIG. 7 is a plan view of a built-in antenna 30 according to a third exemplary embodiment of the present invention. The antenna 30 has the same configuration as the antenna 10 of FIGS. 2-3, except that the short-circuited stub 114 extending from the first radiator is replaced with a short circuited stub 314 extending from an RF feeding portion.

An antenna radiator 31 is placed in a non-conductive area 121 of a PCB 12. The antenna radiator 31 includes a feeding portion 311 having a specific length and electrically connected to an RF node 123, a first radiating portion 312 branched from the feeding portion 311 and placed to be connected to a capacitor C in series, and a second radiating portion 313 extended in a direction in which the first radiating portion 312 is branched from an end portion of the feeding portion 311. In this case, an end portion of the first radiating portion 312 is electrically connected to a conductive area 122 of the PCB 12, and an end portion of the second radiating portion 313 is open and thus is not connected to the conductive area 122 of the PCB 12. Unlike FIG. 2, a conductive pattern 314 is branched in an opposite direction of the first radiating portion 312 in the feeding portion 311 and is electrically connected to the conductive area 122 of the PCB 12.

Accordingly, in the embodiments of FIGS. 6-7, the conductor area 122 extends from the far side (right hand side) to a central region beneath the non-conductive area 121 and to a near side region, to thereby surround the non-conductive area 121 on at least three sides. The stub connection is made to the conductive area 122, the stub extending from the feeding portion to connect to either the central region or the near side region of the conductive area 122.

Figure 8:
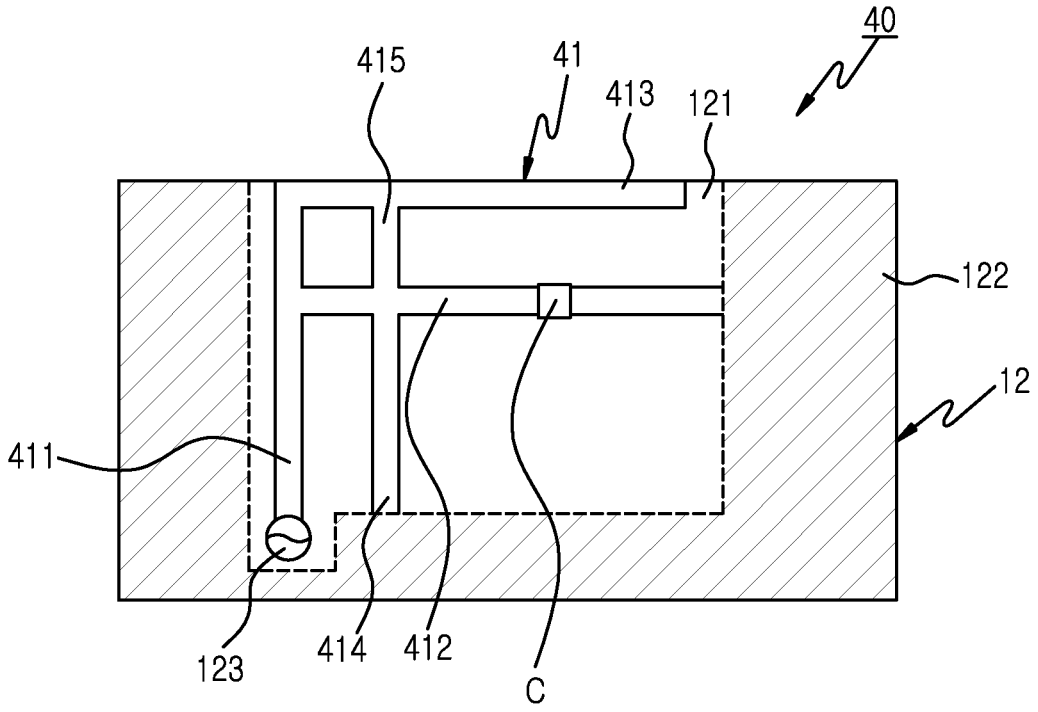
FIG. 8 is a plan view of a built-in antenna according to a fourth exemplary embodiment of the present invention.

FIG. 8 is a plan view of a built-in antenna 40 according to a fourth exemplary embodiment of the present invention. The antenna 40 has the same configuration as the antenna 10 of FIGS. 2-3, except that an additional stub connection 415 is made between the second radiating portion and the first radiating portion in the area of the short circuited stub.

An antenna radiator 41 is disposed at a non-conductive area 121 of a PCB 12. The antenna radiator 41 includes a feeding portion 411 having a specific length and electrically connected to an RF node 123, a first radiating portion 412 branched from the feeding portion 411 and placed to be connected to a capacitor C in series, and a second radiating portion 413 extended in a direction in which the first radiating portion 412 is branched from an end portion of the feeding portion 411. In this case, an end portion of the first radiating portion 412 is electrically connected to a conductive area 122 of the PCB 12, and an end portion of the second radiating portion 413 is open and thus is not connected to the conductive area 122 of the PCB 12. A conductive pattern 414 is branched in the first radiating portion 412 and is electrically connected to the conductive area 11 of the PCB 12, and the second conductive pattern 415 electrically connects the first radiating portion 412 and the second radiating portion 413.

As illustrated in FIG. 6 to FIG. 8, the conductive patterns 214, 314, 414, and 415 are electrically connected to the conductive area 122 of the PCB 12 in various forms at various positions in the radiating portion or the feeding portion. Therefore, a loop structure with various shapes can be configured according to a shape of the conductive pattern, and thus a vendor can provide various antennas by considering a radiation property when designing the antennas.

Figure 9:
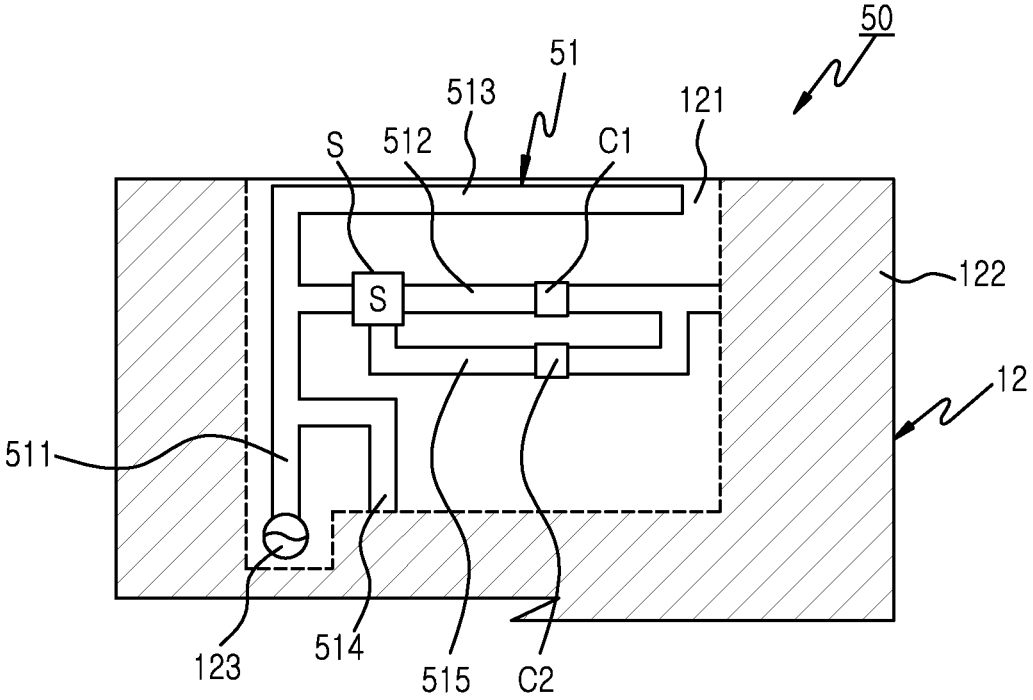
FIG. 9 is a plan view of a built-in antenna according to a fifth exemplary embodiment of the present invention.

FIG. 9 is a plan view of a built-in antenna 50 according to a fifth exemplary embodiment of the present invention. In this embodiment, a switching unit is positioned between separated sections of the first radiating portion. A different radiating portion has one end portion electrically connected to the switching unit and an opposite end portion electrically connected to the conductive area or to the end portion of the first radiating portion. A second capacitor is electrically connected in series within the different radiating portion and has a different capacitance value than the first capacitor. The switching unit is controllable to switch a connection of the power feeding portion between the first and different radiating portions, the first or different radiating portion being selected to obtain a highest antenna performance. The switching unit performs switching to obtain the highest antenna performance dynamically in consideration of radiation efficiency deterioration of the first or different radiating portions when the electronic device is in a hand-held state.

More specifically, referring to FIG. 9, an antenna radiator 51 includes a feeding portion 511 having a specific length and electrically connected to an RF unit 123, and a first radiating portion 512 branched from the feeding portion 511. A second radiating portion 513 is similar or identical to the second radiating portion 113 of FIGS. 2-3, and can be employed for operation at a high frequency band, e.g., 5 GHGz as in the above-described embodiments.

A first capacitor or capacitor group C1 in inserted in series within the first radiating portion 512. A switch S is likewise inserted in series in the first radiating portion 512. That is, the area of radiating portion 512 beneath the switch S (not shown) is separated, where the switch S is connected across the separated sections. An additional radiating portion 515 is connected in parallel across the first radiating portion 515, with one end connected to the switch S and the opposite end connected either to the conductor area 122 on the far side, or to the opposite end of the first radiating portion 512 as shown. At least one second capacitor or capacitor group C2 is inserted within the radiating portion 515 in series. The first capacitor group C1 and the second capacitor group C2 have different capacitance values.

The first radiating portion 512 and the second radiating portion 515 are selectively switched. The switching unit S is installed to switch the radiating portions. A controller of the electronic device 1 (not shown) controls the switching unit S to alternately switch the first radiating portion 512 and the additional radiating portion 515 and thus can exhibit a superior radiation property of the antenna. On the other hand, a switching operation of the switching unit S may be applied to decrease a Specific Absorption Rate (SAR) having an effect on a human body of a user of the terminal. In addition, the switching unit S may perform switching on a radiating portion by preferentially considering antenna's radiation efficiency deterioration caused when the electronic device is in a hand-held state. For example, when operating at the low frequency band (for which the radiators 512, 515 are non-simultaneously used), the controller monitors antenna performance metrics of a currently used radiator 512 or 515. If the performance drops below a threshold, the controller may immediately control the switch S to switch the path over to the other radiator and ascertain if the antenna performance is improved above the threshold. The controller thus dynamically controls the radiation path to obtain the highest antenna performance.

According to the present invention, at least one capacitor is electrically connected in an antenna radiating portion with a relatively low frequency band and a resonant frequency of an antenna radiator can be modified by regulating a capacitance value. Therefore, an antenna having the same or superior performance can be provided while decreasing the entire volume of a radiator.

In addition, since a space used to install an antenna radiator installed or formed on a PCB is saved, a electronic device can be implemented in a slim size. Since an additional component such as a carrier is excluded, the number of assembly processes is decreased, and a manufacturing cost is decreased, thereby improving productivity.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A built-in antenna apparatus for an electronic device, the antenna apparatus comprising:

a Printed Circuit Board (PCB) including a conductive area and a non-conductive area; and an antenna radiator disposed at the non-conductive area of the PCB, wherein the antenna radiator includes:

a feeding portion to feed signal power to/from a Radio Frequency (RF) node of the PCB;

a first radiating portion configured in a first pattern beginning at a near end thereof from the feeding portion and ending at a far end electrically connected to the conductive area;

at least one capacitor electrically connected in series within the first radiating portion; and a second radiating portion configured in a second pattern branched from the feeding portion on one end and isolated from the conductive area on an opposite end, wherein a resonant frequency of the first radiating portion is a function of a capacitance value of the at least one capacitor.

2. The antenna apparatus of claim 1, wherein the built-in antenna apparatus is a dual-band antenna in which a first antenna radiator comprising the first radiating portion and the feeding portion operates at a first band on the basis of the first pattern, the second antenna radiator comprising the second radiating portion and the feeding portion operates at a second band on the basis of the second pattern, and the first and second radiators are formed in an integral manner.

3. The antenna apparatus of claim 1, wherein the first radiating portion operates at a 2.4 GHz band, and the second radiating portion operates at a 5 GHz band.

4. The antenna apparatus of claim 1, wherein:

the capacitor has a capacitance value that lengthens an effective electrical length of the first radiating portion;

the first radiating portion has a linear pattern substantially entirely from the near end to the far end; and the at least one capacitor is electrically connected in series within the first radiating portion collinearly with the linear pattern of the first radiating portion.

5. The antenna apparatus of claim 1, wherein the near end of the first radiating portion is branched from the feeding portion, the first radiating portion being an Inverted F Antenna type radiator having a stub located closer to the near end than to the far end, the stub being electrically connected to the conductor area.

6. The antenna apparatus of claim 5, wherein the second radiating portion is an L-shaped radiator.

7. The antenna apparatus of claim 1, wherein the antenna radiator is at least one of a strip conductor formed or installed in the non-conductive area of the PCB, a metal plate, and a Flexible Printed Circuit (FPC).

8. The antenna apparatus of claim 1, a switching unit positioned between separated sections of the first radiating portion;

at least one different radiating portion having one end portion electrically connected to the switching unit and an opposite end portion electrically connected to the conductive area; and at least one second capacitor electrically connected in series within the different radiating portion and having a different capacitance value than the at least one first capacitor, wherein the switching unit is controllable to switch a connection of the feeding portion between the first and different radiating portions, the first or different radiating portion being selected to obtain a highest antenna performance.

9. The antenna apparatus of claim 8, wherein the switching unit performs switching to obtain the highest antenna performance dynamically in consideration of radiation efficiency deterioration of the first or different radiating portions when the electronic device is in a hand-held state.

10. The antenna apparatus of claim 1, wherein:

the feeding portion is in the form of a conductive strip on the same surface as the first and second radiating portions; and the first radiating portion and a majority portion of the second radiating portion are oriented substantially parallel to each other and each are substantially perpendicular to the feeding portion, and wherein the first and second radiating portions are each oriented from near to far sides of the non-conductive area, the feeding portion is disposed at the near side, the conductor area is disposed at least at a side region adjacent to the far side of the non-conductive area, and the far end of the first radiating portion is connected to the conductive area at the side region adjacent to the far side.

11. The antenna apparatus of claim 10, wherein the conductor area further extends to a central region beneath the non-conductive area, and the first radiating portion has a stub in the vicinity of the near side which connects to the central region of the conductive area.

12. The antenna apparatus of claim 10, wherein:

the conductor area further extends to a central region beneath the non-conductive area and to a near side region, to thereby surround the non-conductive area on at least three sides; and a stub connection is made to the conductive area, the stub extending from the feeding portion to connect to one of the central region and the near side region of the conductive area.

13. An electronic device comprising:

a Printed Circuit Board (PCB) including a conductive area and a non-conductive area; and an antenna radiator disposed at the non-conductive area of the PCB;

wherein the antenna radiator includes:

a feeding portion to feed signal power to/from a Radio Frequency (RF) node of the PCB;

a radiating portion configured in a pattern beginning at a near end thereof from the feeding portion and ending at a far end electrically connected to the conductive area; and at least one capacitor electrically connected in series within the radiating portion; and wherein a resonant frequency of the first radiating portion is a function of a capacitance value of the at least one capacitor.

14. The electronic device of claim 13, wherein the antenna radiator is a dual-band antenna in which a first antenna radiator comprising the radiating portion and the feeding portion operates at a first band on the basis of the pattern and, a second antenna radiator comprising a second radiating portion and the feeding portion operates at a second band on the basis of a second pattern, and the first and second antenna radiators are formed in an integral manner.

15. The electronic device of claim 14, wherein the near end of the first radiator is branched from a feed point of the feeding portion, the first radiator being an Inverted F Antenna type radiator having a stub located closer to the near end than to the end position, the stub being electrically connected to the conductor area, and the second radiating portion is an L-shaped radiator.

16. The electronic device of claim 13, wherein:

the capacitor has a capacitance value that results in lengthening an effective electrical length of the first radiator;

the radiating portion has a linear pattern substantially entirely from the near end to the far end; and the at least one capacitor is electrically connected in series within the first radiating portion collinearly with the linear pattern of the first radiating portion.

17. The electronic device claim 13, wherein the non-conductive area has a near side at which the feeding portion is disposed, and a far side, the conductor area being disposed at least at a side region adjacent to the far side of the non-conductive area, and the far end of the first radiating portion is connected to the conductive area at side region.

18. An electronic device comprising:

a Printed Circuit Board (PCB) including a conductive area and a non-conductive area; and an antenna radiator disposed at the non-conductive area of the PCB, wherein the antenna radiator includes:

a feeding portion to feed signal power to/from a Radio Frequency (RF) node of the PCB;

a radiating portion configured in a pattern beginning from the feeding portion;

a switching unit positioned between the feeding portion and a separated sections of the radiating portion;

wherein the radiating portion comprises:

a first radiating section having a first end connected to the switching unit, an opposite end connected to the conductive area, and at least one first capacitor connected in series within the first radiating section; and at least one second radiating section having one end portion electrically connected to the switching unit and an opposite end portion electrically connected to the conductive area with at least one second capacitor electrically connected in series within the second radiating section and having a different capacitance value than the at least one first capacitor, wherein the switching unit is controllable to switch a connection of the feeding portion between the first and second radiating sections, the first or second radiating section being selected to obtain a highest antenna performance.

19. The electronic device of claim 18, wherein the switching unit performs switching to obtain the highest antenna performance dynamically in consideration of radiation efficiency deterioration of the first and second radiating sections when the electronic device is in a hand-held state.

20. The electronic device of claim 18, wherein the separated section of the radiating portion is a first separated section, and the switching unit is positioned between the first separated section and a second separated section of the radiating portion, the second separated section being connected directly to the feeding portion.

* * * * *

UNITED STATES PATENT AND TRADEMARK OFFICE

CERTIFICATE OF CORRECTION

PATENT NO. : 9,035,837 B2
APPLICATION NO. : 13/747829
DATED : May 19, 2015
INVENTOR(S) : Yong-Soo Kwak et al.

It is certified that error appears in the above-identified patent and that said Letters Patent is hereby corrected as shown below:

Title Page, Item 73 should read as follows:
--...Samsung Electronics Co., Ltd.,...--

In the Claims

Column 10, Claim 13, Line 65 should read as follows:
--...of the radiating portion...--

Column 11, Claim 17, Line 24 should read as follows:
--...device of claim 13...--

Column 12, Claim 18, Line 6 should read as follows:
--...separated section of the...--

Signed and Sealed this
Twenty-fifth Day of August, 2015

Michelle K. Lee

Michelle K. Lee
*Director of the United States Patent and Trademark Office*